US011357378B2

(12) United States Patent
Li et al.

(10) Patent No.: US 11,357,378 B2
(45) Date of Patent: Jun. 14, 2022

(54) FLOOR SWEEPER

(71) Applicant: Jiaxing Iclean Smart Household Co., Ltd, Jiaxing (CN)

(72) Inventors: Jing Li, Jiaxing (CN); Xuman Deng, Jiaxing (CN); Hongwei Liu, Jiaxing (CN)

(73) Assignee: JIAXING ICLEAN SMART HOUSEHOLD CO., LTD, Jiaxing (CN)

( * ) Notice: Subject to any disclaimer, the term of this patent is extended or adjusted under 35 U.S.C. 154(b) by 276 days.

(21) Appl. No.: 16/741,752

(22) Filed: Jan. 14, 2020

(65) Prior Publication Data

US 2020/0237175 A1 Jul. 30, 2020

(30) Foreign Application Priority Data

Jan. 28, 2019 (CN) ..... 201910080544.6

(51) Int. Cl.

| | |
|---|---|
| ***A47L 11/40*** | (2006.01) |
| ***A47L 11/22*** | (2006.01) |
| ***A47L 11/33*** | (2006.01) |

(52) U.S. Cl.

CPC ..... *A47L 11/4013* (2013.01); *A47L 11/22* (2013.01); *A47L 11/33* (2013.01); *A47L 11/4041* (2013.01); *A47L 11/4069* (2013.01)

(58) Field of Classification Search

CPC ..... A47L 11/22; A47L 11/33; A47L 11/4013; A47L 11/4041; A47L 11/4069

See application file for complete search history.

(56) References Cited

U.S. PATENT DOCUMENTS

2010/0319148 A1* 12/2010 Yu ..... A47L 11/4025 15/97.1

* cited by examiner

*Primary Examiner* — Randall E Chin

(74) *Attorney, Agent, or Firm* — Bayramoglu Law Offices LLC

(57) ABSTRACT

A floor sweeper includes a housing which has a garbage cavity for containing garbage. The garbage cavity has an inlet allowing the garbage to enter the garbage cavity. A sweeping roller is disposed at the inlet of the garbage cavity, is rotatably connected to the housing and is able to sweep outside garbage into the garbage cavity. A sealing plate for opening/closing the inlet is disposed at the inlet of the garbage cavity. An ejector rod is vertically and movably connected to the housing, has an upper end connected to the sealing plate and is able to move vertically to drive the sealing plate to move. When floor sweeper cleans a floor, the ejector rod abuts against the floor and moves upwards to drive the sealing plate to move to open the inlet of the garbage cavity.

17 Claims, 5 Drawing Sheets

FLOOR SWEEPER

CROSS REFERENCE TO THE RELATED APPLICATIONS

This application is based upon and claims priority to Chinese Patent Application No. 201910080544.6, filed on Jan. 28, 2019, the entire contents of which are incorporated herein by reference.

TECHNICAL FIELD

The utility model relates to a floor sweeper, and belongs to the technical field of cleaning tools.

BACKGROUND

Existing floor sweepers for cleaning floors have a garbage collection cavity therein. When the floor sweepers are used for cleaning a floor, a sweeping roller of the floor sweepers sweeps garbage into the garbage collection cavity from the floor. When the floor sweepers are moved to another region from one region which has been completely cleaned, the garbage in the garbage collection cavity may leak via a garbage inlet due to bumps, which brings troubles to users.

SUMMARY

The objective of the utility model is to overcome the shortcomings of the prior art by providing a floor sweeper which is reasonable in structural design, capable of being used smoothly, and convenient to maintain.

The technical solution adopted by the utility model is as follows: a floor sweeper comprises a housing, wherein the housing has a garbage cavity for containing garbage, the garbage cavity has an inlet allowing the garbage to enter the garbage cavity, a sweeping roller is disposed at the inlet of the garbage cavity, is rotatably connected to the housing and is able to sweep outside garbage into the garbage cavity, a sealing plate for opening/closing the inlet is disposed at the inlet of the garbage cavity, and an ejector rod is vertically and movably connected to the housing, has an upper end connected to the sealing plate and is able to move vertically to drive the sealing plate to move; when the floor sweeper cleans a floor, the ejector rod abuts against the floor and moves upwards to drive the sealing plate to move to open the inlet of the garbage cavity; and when the floor sweeper is lifted off the floor, the ejector rod leaves the floor, and the sealing plate seals the inlet of the garbage cavity.

Wherein, the sealing plate is rotatably connected to the housing.

Wherein, the sealing plate is provided with a link shaft, the upper end of the ejector rod is formed with a moving slot, the link shaft is disposed in the moving slot, and the moving slot moves vertically to drive the sealing plate to rotate through the link shaft; or, connection objects of the link shaft and the moving slot are exchanged.

Wherein, a connecting-rod structure is arranged between the sealing plate and the ejector rod and converts a force generated by vertical movement of the ejector rod into a force for rotation of the sealing plate.

Wherein, the sealing plate is slidably connected to the housing.

Wherein, the floor sweeper further comprises an elastic piece connected to the link shaft or the sealing plate, and the elastic piece applies a force to the link shaft or the sealing plate to enable the sealing plate to seal the inlet.

Wherein, a wheel is rotatably arranged at a lower end of the ejector rod.

Wherein, the housing has a mounting groove used for mounting the sweeping roller and having an opening, and the sweeping roller is provided with a flanged shaft sleeve rotatably connected to the sweeping roller; and when the sweeping roller is mounted in the mounting groove, a part with a large outer diameter of the flanged shaft sleeve covers the outer edge of the mounting groove, and a cover plate covers the mounting groove to seal the opening of the mounting groove.

Wherein, a part with a small outer diameter of the flanged shaft sleeve is provided with teeth, the cover plate is provided with sawteeth corresponding to the teeth, and when the cover plate covers the mounting groove, the teeth are engaged with the sawteeth.

Wherein, a rotary shaft is rotatably connected to the housing, the sweeping roller has a drive connecting groove having an opening, and the rotary shaft is in drive connection with the drive connecting groove via the opening of the drive connecting groove.

Wherein, the rotary shaft has a non-circular cross section.

Compared to prior art, the utility model has the following advantages and effects: the problem that an inlet of existing floor sweepers cannot be sealed in a non-working state, and consequentially, garbage leaks via the inlet due to bumps in the non-working state is solved; and the simplest and most practical design is adopted to control the sealing plate in this application, so that the stability and reliably can still be maintained under repeated operation.

The sweeping roller of the utility model is of a detachable structure, and thus can be assembled and disassembled rapidly and can be conveniently maintained later.

DETAILED DESCRIPTION OF THE EMBODIMENTS

Figure 1:
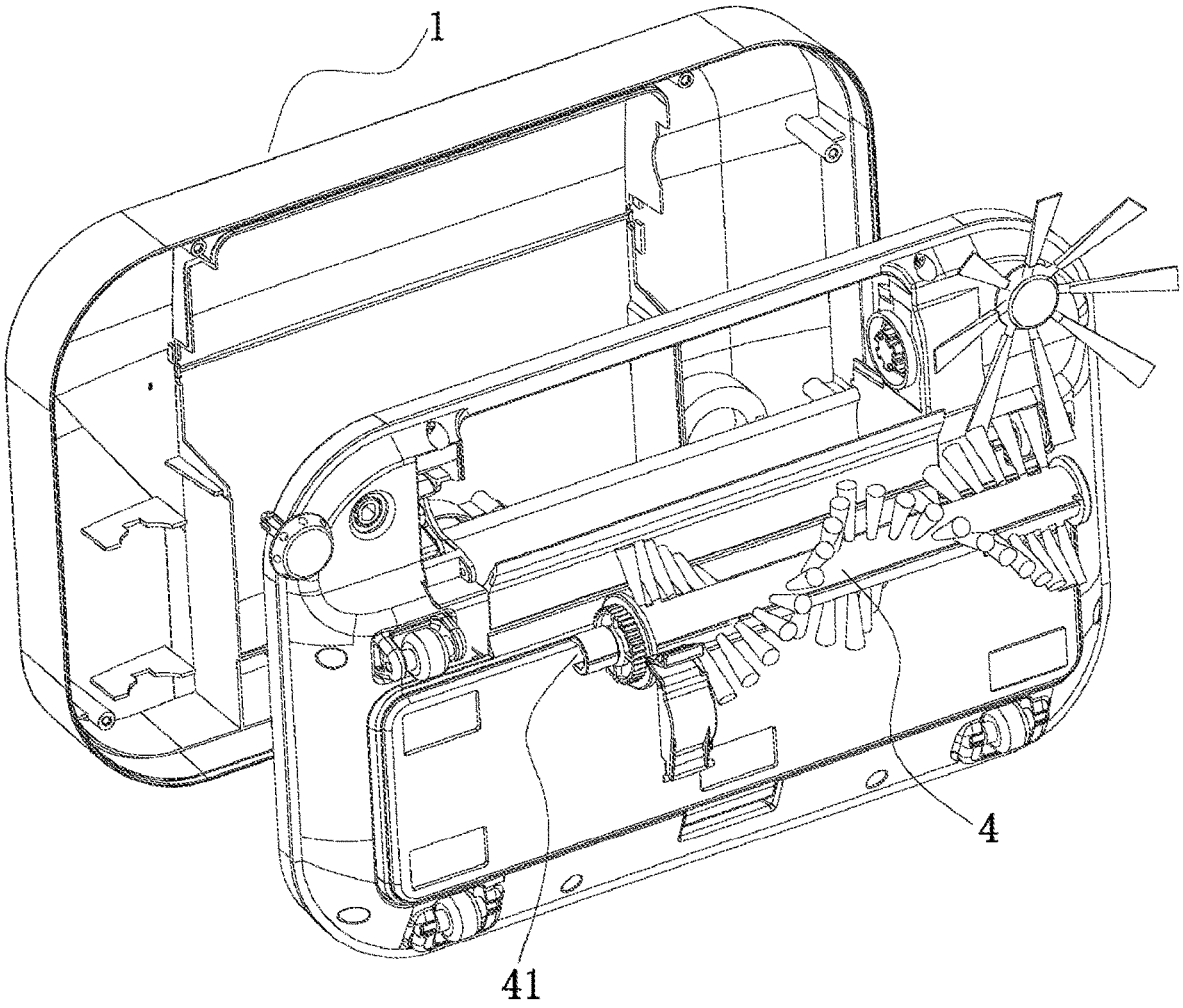
FIG. 1 is a structural view of one embodiment of the utility model.
Figure 2:
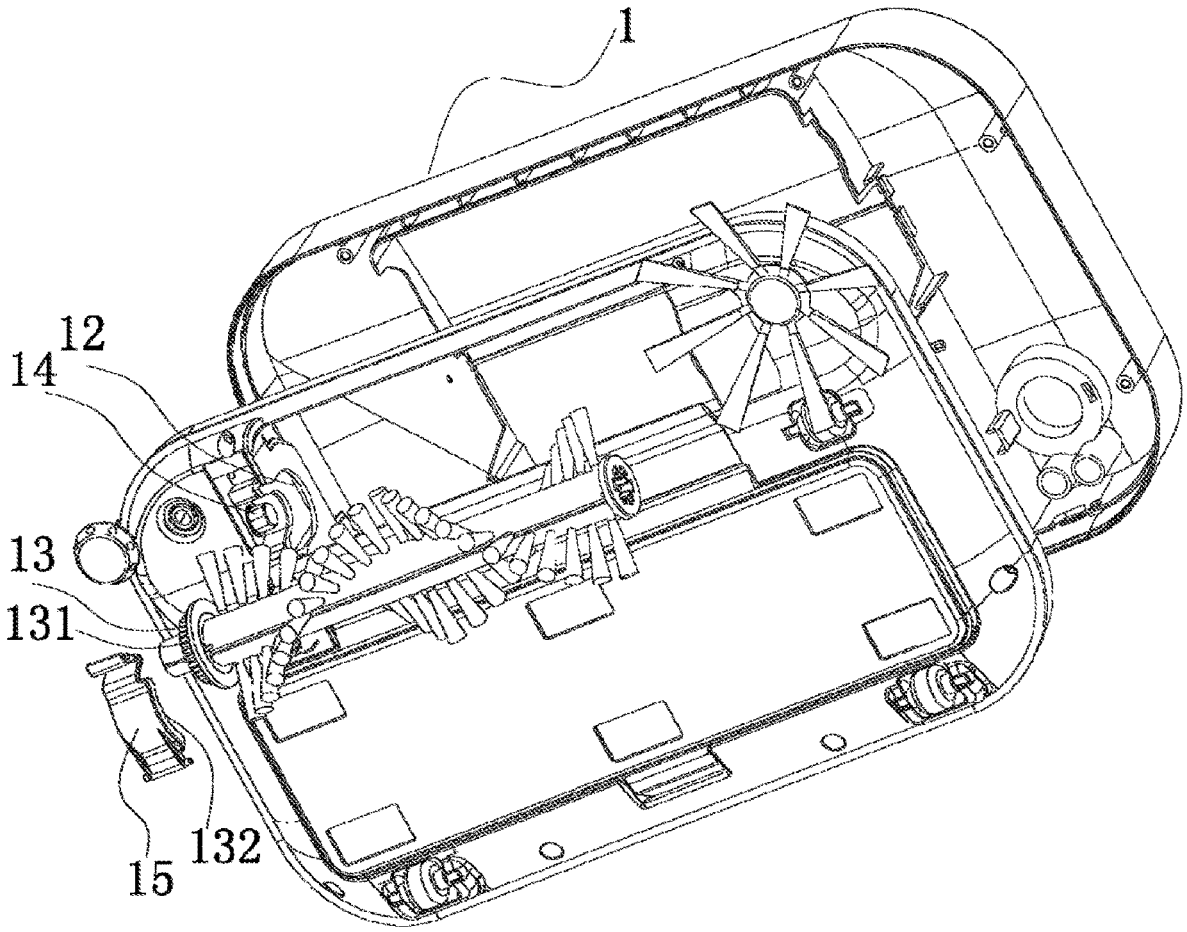
FIG. 2 is another structural view of FIG. 1.
Figure 3:
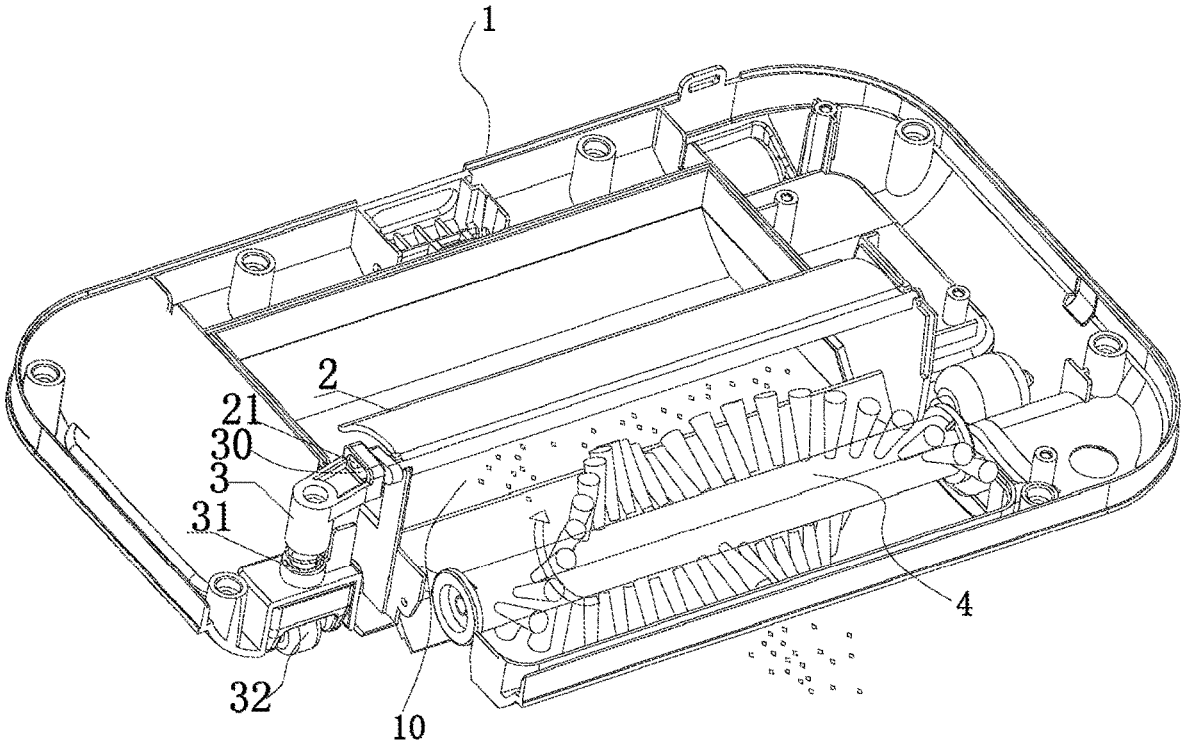
FIG. 3 is a structural view of an inlet of a garbage cavity in an open state in this embodiment.
Figure 4:
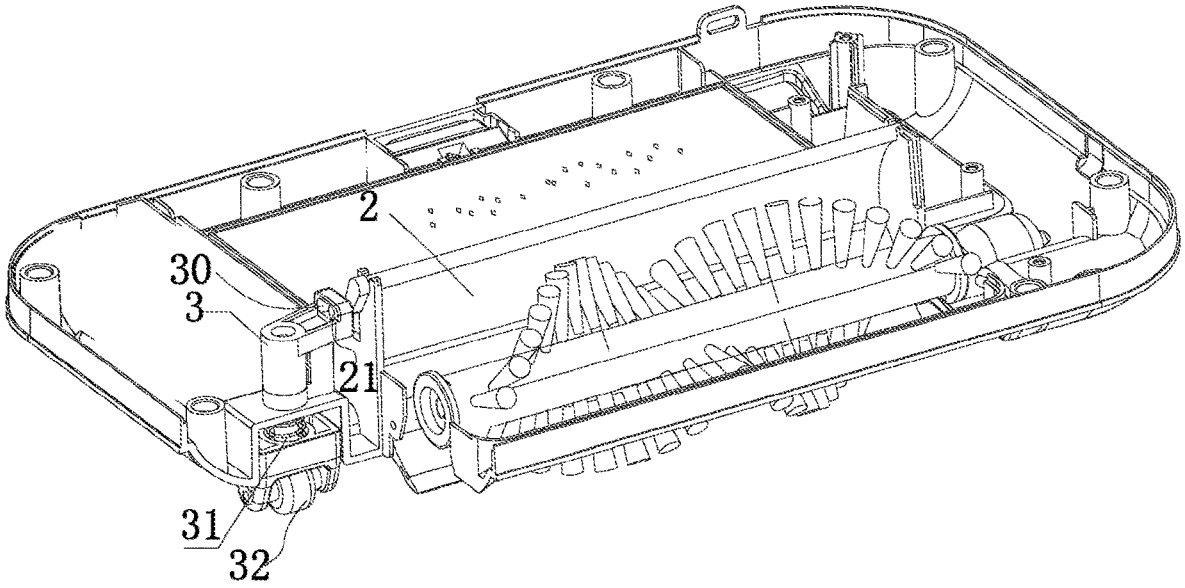
FIG. 4 is a structural view of the inlet of the garbage cavity in a sealed state in this embodiment.

The utility model is further described below in combination with the drawings attached to the specification.

Embodiment 1

As shown in FIG. 1-FIG. 4, a floor sweeper comprises a housing 1, wherein the housing 1 has a garbage cavity for containing garbage, the garbage cavity has an inlet 10 allowing the garbage to enter garbage cavity, a sweeping roller 4 is arranged at the inlet 10 of the garbage cavity, is rotatably connected to the housing 1 and is able to rotate to sweep outside garbage into the garbage cavity, a sealing plate 2 for opening/closing the inlet 10 is arranged at the inlet 10 of the garbage cavity, and an ejector rod 3 is vertically and movably connected to the housing 1. In a specific implementation of this embodiment, the housing 1 has a vertical channel having two through ends, and the ejector rod 3 is disposed in the channel, is limited by the four walls of the channel and is able to move in an extension direction of the channel. The ejector rod 3 has an upper end rotatably, slidably or fixedly connected to the sealing plate 2, and in this embodiment, the upper end of the ejector rod 3 is not limited to the tail of the upper end of the ejector rod 3. The ejector rod 3 moves vertically to drive the sealing plate 2 to move. When the floor sweeper cleans a floor, the ejector rod 3 abuts against the floor and moves upwards to drive the sealing plate 2 to move to open the inlet 10 of the garbage cavity. When the floor sweeper is lifted off the floor, the ejector rod 3 leaves the floor, and the sealing plate 2 seals the inlet 10 of the garbage cavity. In an implementation of this embodiment, when the floor sweeper cleans the floor, the ejector rod 3 moves vertically, a lower end of the ejector rod 3 is supported on the floor and is then ejected to move upwards to drive the sealing plate 2 to move to open the inlet 10 of the garbage cavity; and when the floor sweeper is lifted off the floor, the ejector rod 3 will not be supported by the floor anymore, and the sealing plate 2 seals the inlet 10 of the garbage cavity by gravity, or an external force is applied to the sealing plate 2 to seal the inlet 10 of the garbage cavity.

In this embodiment, the sealing plate 2 is rotatably connected to the housing 1. In a specific implementation, the sealing plate 2 is provided with a circular shaft, the housing 1 has a shaft hole or a shaft groove allowing the circular shaft to be mounted therein, and after the sealing plate 2 is assembled on the housing 1, the sealing plate 2 is able to rotate with the circular shaft as a rotation point.

In this embodiment, the sealing plate 2 is provided with a link shaft 21 fixedly connected to the sealing plate 2, the upper end of the ejector rod 3 is formed with a moving slot 30, the link shaft 21 is disposed in the moving slot 30 which has a width slightly greater than the outer diameter of the link shaft 21 and is able to move vertically, and the link shaft 21 moves in the lengthwise direction of the moving slot 30 to drive the sealing plate 2 to rotate; or, the connection objects of the link shaft 21 and the moving slot 30 are exchanged, that is, the ejector rod 3 is provided with the link shaft 21, the sealing plate 2 is formed with the moving slot 30, and the link shaft 21 is disposed in the moving slot 30.

Figure 5:
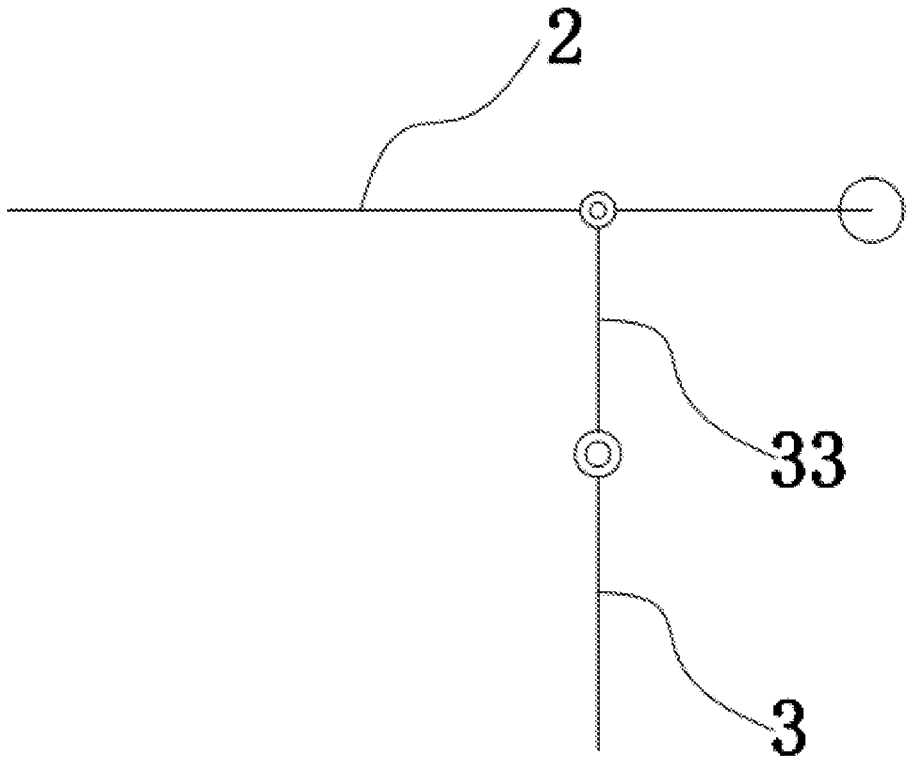
FIG. 5 is a structural view of a connecting-rod structure used for controlling a sealing plate in this embodiment.

As shown in FIG. 5, another connection manner for controlling the sealing plate 2 is as follows: a connecting-rod structure is arranged between the sealing plate 2 and the ejector rod 3 in this embodiment and converts a force generated by vertical movement of the ejector rod 3 into a force for rotation of the sealing plate 2. In a specific implementation, the connecting-rod structure is so implemented that a connecting rod 33 has two ends rotatably connected to the sealing plate 2 and the ejector rod 3 respectively and ejects the sealing plate 2 when the ejector rod 3 moves upwards. In other transformations, two or more connecting rods are configured and interact with one another. All these implementations are a broad summary of the connecting-rod structure, are clear and implementable for those skilled in the art and will not be detailed anymore herein.

In this embodiment, the sealing plate 2 is slidably connected to the housing 1. Preferably, the housing 1 has a sliding groove allowing the sealing plate 2 to be mounted therein, and the sealing plate 2 is slidably arranged in the sliding groove. The ejector rod 3 is fixedly connected to the sealing plate 2 and is able to move vertically to drive the sealing plate 2 to slide in the sliding groove.

The floor sweeper in this embodiment further comprises an elastic piece 31 which is connected to the link shaft 21 or the sealing plate 2 and applies a force to the link shaft 21 or the sealing plate 2 to enable the sealing plate 2 to seal the inlet 10. The elastic piece 31 is a torsion spring having an end connected to the sealing plate 2 and an end connected to the housing 1; and when the inlet 10 is opened, the torsion spring is compressed to apply a reactive force to the sealing plate 2 to seal the inlet 10. The elastic piece 31 is a spring which is able to eject the ejector rod 3 to move downwards to enable the sealing plate 2 to seal the inlet 10.

In this embodiment, a wheel 32 is rotatably arranged at the lower end of the ejector rod 3. In general, wheels are disposed under the floor sweeper. By means of the wheel 32 arranged at the lower end of the ejector rod 3, the lower end of the ejector rod 3 is in rolling friction with the floor, so that the resistance is small, and an extra wheel does not need to be arranged anymore.

In this embodiment, the housing 1 has a mounting groove 12 allowing the sweeping roller 4 to be mounted therein, wherein the mounting groove 12 has an opening, and a flanged shaft sleeve 13 rotatably connected to the sweeping roller 4 is disposed at an end of the sweeping roller 4; and when the sweeping roller 4 is mounted in the mounting groove 12, a part with a large outer diameter of the flanged shaft sleeve 13 covers the outer edge of the mounting groove 12, and a cover plate 15 covers the mounting groove 12 to seal the opening of the mounting groove 12. The flanged shaft sleeve 13 can prevent garbage from entering the mounting groove 12, which may otherwise hinder the rotation of the sweeping roller 4.

In this embodiment, teeth 131 are arranged on a part with a small outer diameter of the flanged shaft sleeve 13, sawteeth 132 corresponding to the teeth 131 are arranged on the cover plate 15, and when the cover plate 15 covers the mounting groove 12, the teeth 131 are engaged with the sawteeth 132. By means of such a structure, the flanged shaft sleeve 13 can be effectively fastened.

In this embodiment, the rotary shaft 14 is rotatably connected to the housing 1, the sweeping roller 4 is formed with a drive connecting groove 41 which has an opening, and the rotary shaft 14 is in drive connection with the drive connecting groove 41 via the opening of the drive connecting groove 41. The sweeping roller 4 can be radially assembled and disassembled conveniently through the opening structure, and the space is saved.

In this embodiment, the cross section of the rotary shaft 14 is non-circular such as pentagonal, hexagonal or octagonal, so that circumferential force transmission can be realized. The rotary shaft with a regular polygonal cross section can be conveniently and rapidly mounted without alignment.

The embodiments in this specification are described by means of ideal reference plane diagrams and/or sectional views. Therefore, these illustrative drawings can be modified depending on fabrication techniques and/or tolerances. That is, all possible embodiments of this disclosure are not limited to those illustrated in the drawings and should include structural transformations obtained on the basis of the fabrication techniques. Areas shown in the drawings are illustrative and shapes of the areas shown in the drawings are illustrative shapes of the areas of components, but the utility model is, in no aspect, limited to these illustrative features.

What is claimed is:

1. A floor sweeper, comprising a housing, wherein the housing has a garbage cavity for containing garbage, the garbage cavity has an inlet; the garbage enters the garbage cavity through the inlet; and a sweeping roller is disposed at the inlet of the garbage cavity, is rotatably connected to the housing and is configured to sweep outside garbage into the garbage cavity;

a sealing plate for opening or closing the inlet is disposed at the inlet of the garbage cavity; an ejector rod is vertically and movably connected to the housing, has an upper end connected to the sealing plate and is configured to move vertically to drive the sealing plate to move;

when the floor sweeper cleans a floor, the ejector rod abuts against the floor and moves upwards to drive the sealing plate to move to open the inlet of the garbage cavity; and when the floor sweeper is lifted off the floor, the ejector rod leaves the floor, and the sealing plate seals the inlet of the garbage cavity;

the sealing plate is rotatably connected to the housing; and the sealing plate is provided with a link shaft the upper end of the ejector rod is formed with a moving slot the link shaft is disposed in the moving slot and the moving slot moves vertically to drive the sealing plate to rotate through the link shaft or, the sealing plate is provided with the moving slot, and the upper end of the ejector rod is formed with the link shaft.

2. The floor sweeper according to claim 1, wherein a connecting-rod structure is arranged between the sealing plate and the ejector rod and converts a force generated by vertical movement of the ejector rod into a force for rotation of the sealing plate.

3. The floor sweeper according to claim 2 wherein the floor sweeper further comprises an elastic piece connected to the link shaft or the sealing plate, and the elastic piece applies a force to the link shaft or the sealing plate to enable the sealing plate to seal the inlet.

4. The floor sweeper according to claim 2, wherein a wheel is rotatably arranged at a lower end of the ejector rod.

5. The floor sweeper according to claim 1, wherein the floor sweeper further comprises an elastic piece connected to the sealing plate, and the elastic piece applies a force to the sealing plate to enable the sealing plate to seal the inlet.

6. The floor sweeper according to claim 5, wherein a wheel is rotatably arranged at a lower end of the ejector rod.

7. The floor sweeper according to claim 1, wherein a wheel is rotatably arranged at a lower end of the ejector rod.

8. The floor sweeper according to claim 1, wherein a rotary shaft is rotatably connected to the housing, the sweeping roller has a drive connecting groove having an opening, and the rotary shaft is in drive connection with the drive connecting groove via the opening of the drive connecting groove.

9. The floor sweeper according to claim 1, wherein a rotary shaft has a non-circular cross section, wherein the rotary shaft is rotatably connected to the housing.

10. The floor sweeper according to claim 1 wherein the floor sweeper further comprises an elastic piece connected to the link shaft or the sealing plate, and the elastic piece applies a force to the link shaft or the sealing plate to enable the sealing plate to seal the inlet.

11. The floor sweeper according to claim 1, wherein the link shaft is fixedly connected to the sealing plate.

12. The floor sweeper according to claim 1, wherein the moving slot has a width greater than an outer diameter of the link shaft.

13. A floor sweeper, comprising a housing, wherein the housing has a garbage cavity for containing garbage, the garbage cavity has an inlet the garbage enters the garbage cavity through the inlet and a sweeping roller is disposed at the inlet of the garbage cavity, is rotatably connected to the housing and is configured to sweep outside garbage into the garbage cavity;

a sealing plate for opening or closing the inlet is disposed at the inlet of the garbage cavity; an ejector rod is vertically and movably connected to the housing, has an upper end connected to the sealing plate and is configured to move vertically to drive the sealing plate to move;

when the floor sweeper cleans a floor, the ejector rod abuts against the floor and moves upwards to drive the sealing plate to move to open the inlet of the garbage cavity; and when the floor sweeper is lifted off the floor, the ejector rod leaves the floor, and the sealing plate seals the inlet of the garbage cavity;

wherein the sealing plate is connected to the housing in a linear sliding manner.

14. The floor sweeper according to claim 13 wherein the floor sweeper further comprises an elastic piece connected to the link shaft or the sealing plate, and the elastic piece applies a force to the link shaft or the sealing plate to enable the sealing plate to seal the inlet.

15. The floor sweeper according to claim 13, wherein a wheel is rotatably arranged at a lower end of the ejector rod.

16. A floor sweeper, comprising a housing, wherein the housing has a garbage cavity for containing garbage, the garbage cavity has an inlet the garbage enters the garbage cavity through the inlet and a sweeping roller is disposed at the inlet of the garbage cavity, is rotatably connected to the housing and is configured to sweep outside garbage into the garbage cavity;

a sealing plate for opening or closing the inlet is disposed at the inlet of the garbage cavity; an ejector rod is vertically and movably connected to the housing, has an upper end connected to the sealing plate and is configured to move vertically to drive the sealing plate to move;

when the floor sweeper cleans a floor, the ejector rod abuts against the floor and moves upwards to drive the sealing plate to move to open the inlet of the garbage cavity; and when the floor sweeper is lifted off the floor, the ejector rod leaves the floor, and the sealing plate seals the inlet of the garbage cavity;

wherein the housing has a mounting groove for mounting the sweeping roller; the mounting groove is provided with an opening; the sweeping roller is provided with a flanged shaft sleeve rotatably connected to the sweeping roller; and when the sweeping roller is mounted in the mounting groove, a part with a large outer diameter of the flanged shaft sleeve covers an outer edge of the mounting groove, and a cover plate covers the mounting groove to seal the opening of the mounting groove.

17. The floor sweeper according to claim 16, wherein a part with a small outer diameter of the flanged shaft sleeve is provided with teeth; the cover plate is provided with sawteeth corresponding to the teeth; and when the cover plate covers the mounting groove, the teeth are engaged with the sawteeth.

* * * * *